United States Patent [19]

Doyle et al.

[11] 4,419,536

[45] Dec. 6, 1983

[54] MEANS FOR AFFIXING AN ELECTRONIC COMPONENT ON A SUPPORTING MEDIUM

[75] Inventors: Richard F. Doyle, Corfu; Thomas E. Gausman, Batavia; Edward T. Myers, Tonawanda, all of N.Y.

[73] Assignee: North American Philips Consumer Electronics Corp., New York, N.Y.

[21] Appl. No.: 363,368

[22] Filed: Mar. 30, 1982

Related U.S. Application Data

[63] Continuation of Ser. No. 87,356, Oct. 23, 1979, abandoned.

[51] Int. Cl.[3] ..... H01F 27/40

[52] U.S. Cl. ..... 174/52 R; 336/105; 336/192; 361/380; 361/420

[58] Field of Search ..... 336/105, 192; 338/315, 338/316–320; 363/68, 126, 144, 146; 361/331, 332, 334, 380, 417, 419, 420; 174/52 R

[56] References Cited

U.S. PATENT DOCUMENTS

| | | | |
|---|---|---|---|
| 2,596,237 | 5/1952 | Gross | 338/320 |
| 2,836,693 | 5/1958 | Yarbrough | 338/320 |
| 2,990,500 | 6/1961 | Mierendorf | 361/420 |
| 3,237,143 | 2/1966 | Baranowski, Jr. | 338/315 |
| 4,091,349 | 5/1978 | Niederjohn | 336/192 |
| 4,195,278 | 3/1980 | Doyle | 336/192 |

*Primary Examiner*—G. P. Tolin

*Attorney, Agent, or Firm*—Thomas A. Briody; William J. Streeter; Charles E. Quarton

[57] ABSTRACT

The invention provides efficient means for orienting an electronic component on a supporting medium, whereby the axially extending leads of the component are simultaneously positioned in an upstanding manner, for connective purposes, at the time the component is affixed to the supporting medium. This is accomplished by the provision of a pair of linearly-related and spatially separated single slot structures formed on the supporting medium. Extremital end-walls, being angularly related to the bottom plane of the slots, effect the desired outward positioning of the distal portions of the respective leads at the time the proximal portions thereof are suitably affixed in the slots. The invention eliminates the need for separate connective stakings in the supportive medium.

5 Claims, 5 Drawing Figures

MEANS FOR AFFIXING AN ELECTRONIC COMPONENT ON A SUPPORTING MEDIUM

This is a continuation of application Ser. No. 087,356, filed Oct. 23, 1979, and now abandoned.

TECHNICAL FIELD

This invention relates to a means and method for affixing and utilizing an electronic component on a non-conductive supporting medium whereby the connective leads of the component are bent to provide discrete terminals for connection to associated circuitry at the time of component affixation.

BACKGROUND ART

In electronic equipment it is conventional practice to mount the various components, constituting the circuitry, on non-conductive supporting mediums. Such supporting means are formed of insulative materials in shapes suitable for the intended usage, as for example, substantially planar, configurated, arcuate or cylindrical manifestations. Regardless of the shaping, many of the supporting mediums are fabricated to contain a plurality of separate upstanding metallic pins or posts to provide means for positioning and connecting certain components of the circuitry, such as resistors, capacitors and semiconductive devices. Non-conductive supporting mediums so staked are extensively utilized in selected electronic switching and control applications including audio and video equipment. Basic mediums, with projecting inserted stakings, require careful handling during fabrication, transportation and storage to prevent the pins from being bent and the mediums from being unduly stressed and cracked. Mediums evidencing staking-related damage represent additional material, time and labor expenditures which appreciably increase manufacturing costs of the respective items.

DISCLOSURE OF THE INVENTION

The present invention is addressed to means for discretely orienting the axial leads of an electronic component on a non-conductive supporting medium in a manner that the leads are expeditiously formed, during the circuit assembly procedure, to project outward therefrom thereby providing connective terminals for the associated circuitry. The orientation means is comprised of a pair of linearly-related and spatially separated single slot structures formed on substantially the surface of the supporting medium at the time of medium fabrication. These slots are linearly separated sufficiently to accommodate the body of the component, and the slots per se are dimensionally formed to subsequently receive the two axially extending leads of the associated component. Each of the slots has an extremital end-wall whereof the interior surface is formed at an angle of at least 90 degrees with the bottom plane of the slot. When the component is seated and the proximal portions of the respective leads are affixed in the respective slots, the distal portions of the two opposed leads are simultaneously bent by interaction with the respective end-walls to project outward. The adjacent affixation imparts rigidity to the extending lead portions. Thus, integral terminal means are provided for circuitry connective purposes.

PREFERRED MODE EMBODYING THE INVENTION

Figure 3:
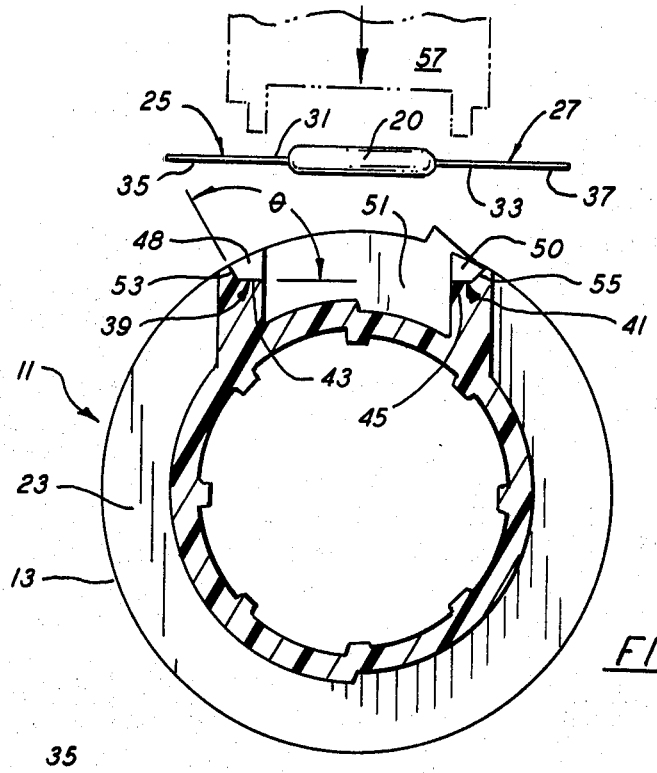
FIGS. 3, 4A and 4B are cross-sectional views taken along the lines 3—3, 4A—4A, and 4B—4B of FIG. 2, illustrating sequential aspects of the invention.
Figure 4A:
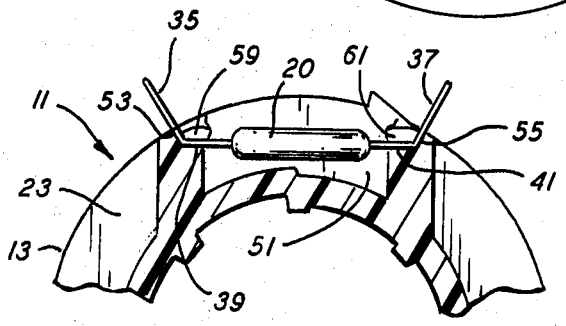
Figure 4B:
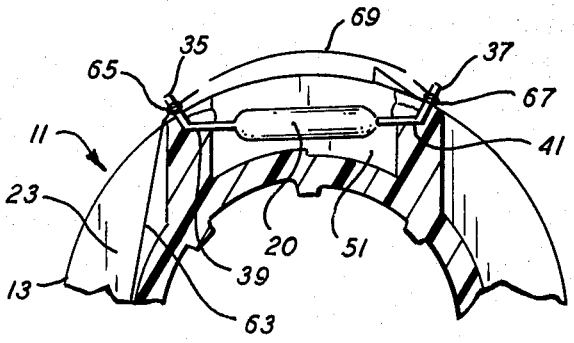

The basic concept of the invention is capable of utilization on several modes of circuit supporting mediums, such as a variety of circuit boards and coil forms incorporating pins or posts for circuitry componental connections. The fundamentals of the component orientation slots, as illustrated in FIGS. 3, 4A and 4B of the drawings, are applicable for usage on supporting mediums that may be either substantially planar or arcuate in surface contour. It is considered that the versatility of the usage is adequately evidenced from the drawings presented. For purposes of example, the invention will be described as incorporated on the secondary bobbin of a flyback transformer of the type employed in television receiver circuitry and other allied video applications. But, such usage is not to be considered as limiting.

Figure 1:
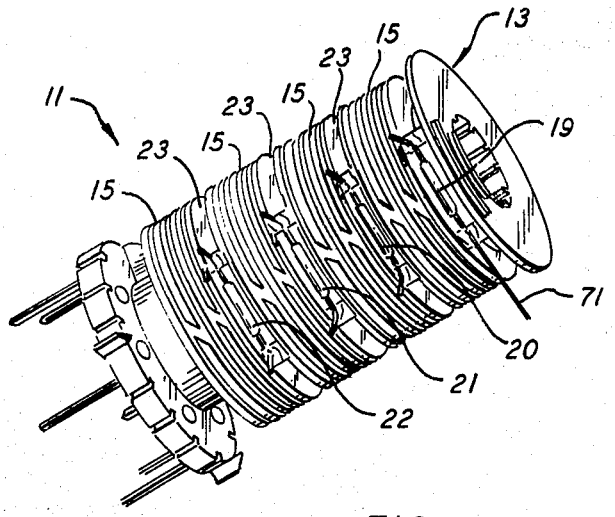
FIG. 1 is a perspective view of an exemplary transformer embodiment wherein the invention is utilized.
Figure 2:
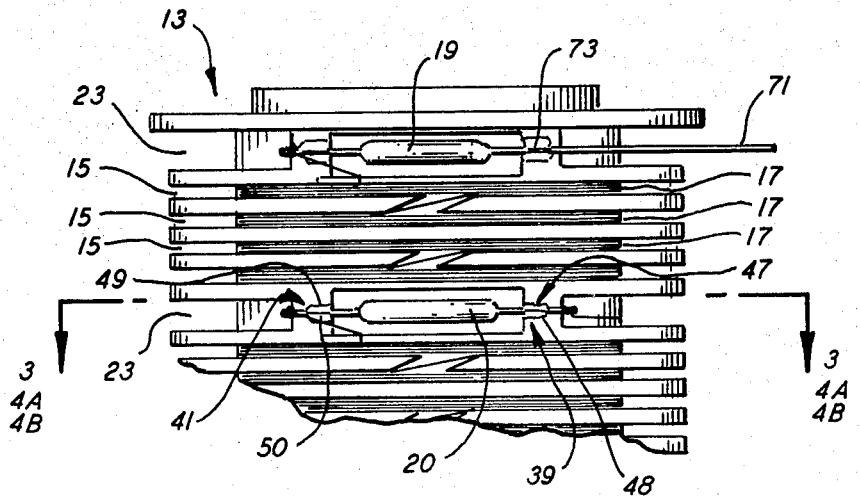
FIG. 2 is an enlarged side view of the forward end portion of the transformer shown in FIG. 1.

With reference to the drawings, there is shown in FIGS. 1 and 2 the partial construction of a flyback transformer 11 which is part of the high voltage circuit of a television receiver, such being connected to the cathode ray tube for purposes of beam acceleration and beam focusing. It is through this transformer and associated circuitry that the horizontal retrace pulses are converted to the required direct current voltage. A flyback component of this type is disclosed in patent application Ser. No. 003,166, filed Jan. 15, 1979, now U.S. Pat. No. 4,195,278 issued Mar. 25, 1981, and assigned to the assignee of the present invention.

The secondary bobbin 13, which is the portion of the transformer structure with which the invention is associated, is formed as a substantially cylindrical member configurated to have a number of circular grooves 15 or isolation means to accommodate the secondary winding, such being comprised of a plurality of series-connected winding units 17 interconnected through a plurality of diode components 19–22. These diodes are positioned in separate bobbin grooves 23, wherein the invention is contained. In this instance, the supporting medium or bobbin is formed of a non-conductive material, as for example, a suitable thermoplastic composition such as Phenylene Oxide or Acrylonitrile Butadiene Styrene.

With reference to FIG. 3, the diode 20, wherefrom two axial connective leads 25 and 27 extend in substantially opposed longitudinal directions, will be considered as an exemplary element. The respective leads for this diode are referenced to have proximal portions 31 and 33 substantially adjacent the body portion, and distal portions 35 and 37 which relate to the terminal regions of the respective leads.

The invention concerns the orientation and affixation of the above-described component and leads. A pair of linearly-related and spatially separated single slot structures 39 and 41 are formed on the supporting medium of the bobbin within the diode-accommodating groove 23. Each of the two associated slots 39 and 41 has a respective bottom portion 43 and 45 and two related sidewalls 47, 48 and 49, 50. These are dimensioned to receive, in a nesting manner, substantially the proximal portions 31 and 33 of the axial leads. The intermediate or linear separation area 51 between the slots is sufficient to adequately accommodate the positioning of the diode body therein. Each of the slots has an extremital end-wall 53 and 55 of which the interior surface is formed at an obtuse angle ∠ with the bottom plane 43 and 45 of the respective slots. The angle is related to the diameter of the bobbin, as the slant substantially coincides with the radius, and for the particular usage described, it fails substantially within the range of about 95 to 125 degrees. This angular relationship effects subsequent positioning of the distal portions of the respective leads to project in a substantially radial manner outward from the body of the bobbin when the proximal portions of the leads are seated in the resepective slots. When the invention is utilized on a planar supporting medium, the angular relationship between the extremital end-wall and the bottom plane of the slot will be at least 90 degrees.

To utilize the invention, reference is directed to FIG. 3 wherein the diode 20 is oriented relative to the pair of slots 39 and 41 with body above the intermediate spacing 51 and each axial lead superjacent to a respective slot. Being so located, the diode is placed on the slots, and the proximal portions 31 and 33 of the respective leads inserted to a seated position therein by appropriate tooling 57, indicated in phantom. This effects the positioning illustrated in FIG. 4A, wherein the distal lead portions 35 and 37 are bent in conformance with the angular relationships of the extremital end-walls 53 and 55 to effect projection of the distal portions in an outward substantially radial direction from the arcuate surface of the bobbin 13.

The proximal portions 31 and 33 of the leads are rigidly affixed within the slots by localized adherence of opposed areas of the adjacent side portions, for example by pressure deformation, such as, heat-pressure swaging of limited regions 59 and 61 of the adjacent slots walls. This is discretely accomplished by the indicated tooling 57.

The wire 63 comprising the secondary winding of the transformer 11 is then wound on the supporting bobbin 13 as a continuous application. The number of turns applied to the respective winding grooves 15 are determined by the performance requirements of the transformer. As the winding reaches a diode, turns are wrapped on each of the distal projections 35 and 37 in sequence, as indicated at 65 and 67, with the wire bridging across therebetween and continuing onward therefrom.

Upon completion of the winding, the wound bobbin is annealed with a temperature/time treatment in accordance with the characteristics of the thermoplastic material used and the compatibility of the associated diodes to relieve any residual molding and swaging stresses which may be present in the structure. In this instance, the wound bobbin is subjected to an annealing treatment of substantially 100 degrees C. for 1 hour. With some thermoplastic materials annealing is not an essential requirement.

In sequential procedures, the turns of wire 65 and 67 on the respective distal portions 35 and 37 are soldered, and the wire bridge 69 therebetween is removed as by clipping. Thus, the series connected secondary winding of the transformer is completed.

In FIGS. 1 and 2, the terminal lead 71 of diode 19 is the electrical connection for the more negative voltage terminal of the secondary winding. It will be noted that this lead projects outward in a somewhat tangential manner for a specific external connective purpose. The slot 73, wherein this lead is affixed, has no formative extremital wall, thus the lead 71 inherently extends therethrough in a plane substantially parallel with the bottom of the slot.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention, which has expeditious utilization in the manufacture of electronic equipment, concerns the orientation and affixation of componential elements on non-conductive supporting mediums which may be either planar, such as circuit boards, or arcuate, as for example, cylindrical transformer bobbins. The slotted affixation means, with associated angularly related extremital end-walls, simultaneously orients the distal portions of the component leads in outward or upstanding connective positions at the time of affixation. The invention eliminates the need for, and the steps for providing, separate insertion of metallic connective pins or stakings in the supportive medium. The manufacturing efficiency afforded by the invention is a beneficial cost reduction consideration.

We claim:

1. A supporting medium for receiving an electronic component having a body portion and a pair of substantially opposed leads extending outward from the body portion in a substantially axial manner, each of said leads having a proximal portion and a distal portion relative to the body portion, said supporting medium comprising a bobbin of non-conductive material having a generally circular disc-like configuration, and having a peripheral portion for receiving an electronic component, slot means formed in the peripheral portion of the bobbin, said slot means including a pair of sidewalls disposed generally co-planar with the bobbin, each sidewall having a bottom portion and an extremital end wall abutting the bottom portion, to form an obtuse angle therewith, said slot means further including a linear separation area between the pair of sidewalls, configured to receive the body portion of an electronic component.

2. The supporting medium of claim 1 wherein said bottom portions are formed substantially along a tangential portion of the generally circular disc-like configuration of the bobbin and extend generally orthogonally upward from the sidewalls.

3. The supporting medium of claim 2 wherein the extremital end walls of said bobbin are formed substantially along a radius of the generally circular disc-like configuration of the bobbin and extend generally orthogonally upward from the sidewalls.

4. The supporting medium of claim 3 wherein the obtuse angle formed by the extremital end walls and the respective sidewalls associated therewith is in the range of about 95 to 125 degrees.

5. The supporting medium of claim 4 wherein the bobbin is formed of a thermoplastic material, whereby said slot means can be deformed under the influence of heat to retain a distal lead portion of an electronic component.

* * * * *